United States Patent [19]

Chaudot

[11] Patent Number: 4,516,932

[45] Date of Patent: May 14, 1985

[54] SAFETY SYSTEM INTENDED IN PARTICULAR TO ELMINATE ENTRAINED OR CONDENSED LIQUIDS, AND TO LIMIT THE HEAT RADIATION WHEN FLARING OR DISPERSING HYDROCARBON GASES

[75] Inventor: Gérard Chaudot, Andresy, France

[73] Assignee: Cabinet Brot, Paris, France

[21] Appl. No.: 489,857

[22] Filed: Apr. 29, 1983

[30] Foreign Application Priority Data

Jun. 5, 1982 [FR] France ..... 82 07917

[51] Int. Cl.[3] ..... F23D 13/20

[52] U.S. Cl. ..... 431/202; 431/114; 431/284

[58] Field of Search ..... 431/5, 114, 202, 284

[56] References Cited

U.S. PATENT DOCUMENTS

| | | | |
|---|---|---|---|
| 3,824,073 | 7/1974 | Straitz | 431/202 X |
| 3,868,210 | 2/1975 | Simpson et al. | 431/202 X |
| 3,954,386 | 5/1976 | Harpenslager et al. | 431/202 X |
| 3,994,671 | 11/1976 | Straitz | 431/202 |
| 4,125,361 | 11/1978 | Bourn | 431/202 X |
| 4,229,157 | 10/1980 | Ito et al. | 431/202 X |
| 4,412,811 | 11/1983 | Pedrosa, Jr. et al. | 431/202 |

FOREIGN PATENT DOCUMENTS

| | | | |
|---|---|---|---|
| 1029289 | 1/1975 | Canada | 431/202 |
| 2195327 | 3/1974 | France | 431/202 |
| 597559 | 4/1978 | Switzerland | 431/202 |
| 2012407 | 7/1979 | United Kingdom | 431/202 |

*Primary Examiner*—Margaret A. Focarino

*Attorney, Agent, or Firm*—Scully, Scott, Murphy and Presser

[57] ABSTRACT

Safety system designed to eliminate liquids entrained or condensed, and to limit the heat radiation and the intensity of the noises received in the flaring or dispersion of gases from the production, processing and transportation of crude hydrocarbons, and elaborated on land or offshore.

The system according to the invention involves a chamber 6 such as a flare-base flask connected to at least one flare stack which includes: a back-pressure device 11 and a tip 5 or an orifice for venting to the atmosphere, and means to pulverize into a mist any drops of liquid remaining in the gas flow, and to insure, rapidly, an intimate mixture of the gas with the ambient air.

This system can be installed on land, at sea, on any type of fixed or floating support.

12 Claims, 20 Drawing Figures

SAFETY SYSTEM INTENDED IN PARTICULAR TO ELMINATE ENTRAINED OR CONDENSED LIQUIDS, AND TO LIMIT THE HEAT RADIATION WHEN FLARING OR DISPERSING HYDROCARBON GASES

BACKGROUND OF THE INVENTION

The present invention relates to a safety system designed to eliminate fallout of liquids and as a function of the fluctuations in the flow to be flared or disposed of, to insure good combustion or good dispersion in order to shorten the flame and diminish the heat radiation and noise intensity received in the installations, during the flaring or dispersion of gases in the production, processing and transportation of hydrocarbons, especially off-shore.

Generally speaking, it is known that the evacuation of liquids, particularly in the form of drops, through the flare tip, as a result, for example, of a liquid congestion of installations upstream, or owing to rapid depressurization of volumes of liquids containing dissolved gases, constitutes a serious danger in installations for the production, processing and transportation of hydrocarbons, and in particular in fixed or floating installations situated off-shore.

As a matter of fact, as they leave the flare tip, the condensates or the oil, issuing from the gas or entrained by the latter, are ignited and fall back in flames on the installation or in the immediate proximity to it, thereby endangering the life of all personnel and the entire installation.

This danger is even greater in off-shore installations since the personnel run the risk of being trapped on the burning platform or floating supports, and furthermore the condensates or oil floating on the water can form a sheet of fire preventing any possibility of evacuation.

Moreover, in installations producing, processing and transporting hydrocarbons, of the gaseous type in particular, it is sometimes necessary, for operational or safety reasons, to vent large quantities of gas in a very short time. The combustion of fluctuating, and sometimes very substantial gas flows leads to the relegation of the flare far from the installations in order not to generate levels of temperature and noise in the latter that are intolerable for the personnel and the equipment. Unfortunately in the case of offshore locations, when the water becomes rather deep, this solution only solves the problem locally at a cost that increases rapidly with the depth of the water. When the water is very deep, the above arrangement becomes problematical and its cost prohibitive. Because this arrangement always creates a substantial interference to navigation, which is always tricky in the vicinity of the installation.

SUMMARY OF THE INVENTION

It is the object of the invention therefore, to eliminate all these drawbacks.

It therefore proposes a safety system constituted by all or part depending on the application, of a set of elements cooperating to:

Eliminate, where the case applies, the liquids entrained or condensed, in the vertical or subvertical part of the flare stack, Pulverize in a mist at the flare tip, the liquid condensations that may be produced in the upper part of the flare stack, in the flare tip and at the vent, with allowance for the evolution during this travel, of the thermodynamic conditions to which the gas is subjected.

Improve the dispersion in the case of a vent, or shorten the flame generated by the combustion of all of the gas to be eliminated, by dividing the total jet into several parallel convergent or divergent jets, and increasing the aeration of the gases as they are vented to the atmosphere.

Put a ceiling on the heat radiation and the intensity of the noises received, regardless of fluctuations in gas-flow, which can reach substantial levels.

In the case of discontinuous venting, to avoid or diminish additional flows of combustible or inert gas, proper to avoiding the entry of air through the flare tip during periods of gas flow shutdown, and thus avoid the risks associated with the correct determination thereof.

In order to achieve these results, the safety system according to the invention therefore introduces into the flow chain of the gas, between the potential source of liquid and the vent to the atmosphere, at least one chamber such as a flare-base flask, connected at its top to at least two flare stacks, or one or more chambers each connected to at least one flare stack, the said flare stacks each comprising:

A standard back-pressure device consisting, for example, of a calibrated check valve or a valve with manual, automatic or piloted operation, the level of the back-pressure exerted on the gas upstream (pressure threshold) being different for each of the flares, so that in the course of a continuous rise in pressure of the gases, a sequential, staged opening of the back-pressure devices is obtained, and thus the velocity of flow of the gases inside the flares will always be relatively high, and A venting tip or orifice making it possible, owing to the high velocity of gas flow, to pulverize as a mist any drops of liquid remaining in the gas flux and quickly insure an intimate mixture of the gas with the ambient air in order to obtain rapid and total combustion and thereby avoid condensation and fallout of liquid drops, flaming or not, in the vicinity thereof.

It should be pointed out that the opening of the said back-pressure devices is gradually adjusted to the flow of gas to be evacuated, without thereby creating an inadmissible pressure or pressure surges in the installations upstream.

Each of these back-pressure devices can be matched, in parallel by a fast positive-opening device such as a bursting plate, for example, making it possible to put a ceiling on the upstream pressure at a pre-selected level, in the event of an accidental blockage of the standard back-pressure device. Each standard back-pressure device can also either be equipped with at least one small leak orifice so that during inoperative periods of the flaring or dispersion system, the flare will continue to be supplied with combustible or inert gas, or equipped with an auxiliary pipe serving the above function, in order to avoid entries of air through the flare tip and the troublesome consequences that could result. Depending on the characteristics of the flare tip, this small leak orifice can be of a less than a flame-choking size, thereby avoiding the installation of auxiliary devices preventing any propagation of the flame.

Moreover, if it is deemed necessary, a device with manual or automatic purge will be provided to collect drips and runoff that can accumulate above the back-pressure devices and interfere with their dependable operation. Likewise, if the formation of hydrates is to be feared, means of heating, or inhibition of formation of hydrates can be incorporated upstream, or in the back-pressure device.

Moreover, below the said back-pressure device, each flare stack can be equipped with, as a nonlimiting example, a liquid drop separator using a centrifugual or other effect, the condensates and liquids thus recovered being reinserted in the subjacent installations at a point where there would be no pressure incompability or prejudicial interferences with safety. Depending on the embodiment chosen, this separator can be equipped with an automatic or manual purge with high-level alarm indicating to the personnel the operating condition of the latter.

Level with the tip or venting orifice of each of the flares, the pulverization of the remaining liquid can be insured, for example, by a venting of the gases at a substantial initial velocity generated by one or more orifices with a thin lip, or through one or more calibrated tubes. This thin-lip orifice or calibrated tube may perhaps fulfill the motor function of a unit based on the Venturi effect, centripetal acceleration or the CO-ANDA effect to entrain the ambient air and mix it intimately with the gas to be flared or dispersed by turbulence and accelerated diffusion.

Moreover, the latter device offers a large number of advantages, among which are:

(a) A shortening of the length of the flame by rapid combustion of the mass of gas released to the atmosphere owing to good aeration on the one hand, and on the other hand to the thinness of the lip /of the/ venting orifice (compared with the length of the flame resulting from the combustion of the entire flow of gas vented through a single pipe of circular section);

(b) A shortening of the length of the flame corresponding to the distribution of the gas flow among the various flare tips. It is recognized, as a matter of fact, that the length of a flame is a function increasing with the diameter of the flare tip when the latter is constituted by a cylindrical tube;

(c) A substantial reduction in the intensity of the noise emitted by the gas jet and the flame corresponding to the distribution of the total flow to be flared. As a matter of fact, experience shows that the total noise emitted by a plurality of jets and flames is less, under certain conditions, than the noise emitted by one of these jets alone;

(d) The venting of the gas can be done through a circular annular section with possible induction of air through the central section, the result is a substantial reduction in volume, even the elimination of the central core of gas at high temperature situated in the heart of the flame, the latter being primarily responsible for the heat radiation of a flame coming from a jet of gas of full circular section. Since this radiation is a cause of insecurity for the personnel and equipment subjected thereto if it is of high intensity, and since its calculation is always subject to caution, it appears primordial to treat the causes thereof in order to better circumvent the effects;

(e) If the gas vent lip is thin enough and the width close to or less than the flame choking distance, there will no longer be any possibility of a flareback inside the flare stack, and consequently it will no longer be necessary to insure a permanent scavenging of the flare with combustible or inert gas, in any event its output can be considerably diminished;

(f) The multiplicity of flare stacks, in the event of substantial fluctuations in flows, in normal operation, or required for reasons of safety, will make it possible to maintain a velocity of flow of the gases in the flare or flares necessary for correct operation of the equipment described above, and to insure the functions described above. Accessorily, the plurality of flare stacks may make it possible to constitute a self-supporting structure /of/ the constituent elements of the flare as well as of elements foreign to the system such as radiocommunication antennas.

Furthermore, in certain applications the flare will be equipped with means for manual or automatic ignition or extinction making it possible to start or smother the flame in various operational configurations, or for reasons of safety or otherwise.

The result, then is a system of very great safety particularly adapted to the needs of flaring or dispersion on confined installations, off shore, for example.

Embodiments of the invention will be described below by way of nonlimiting examples with reference to the attached drawings in which:

DETAILED DESCRIPTION OF THE PREFERRED EMBODIMENTS

Figure 1:
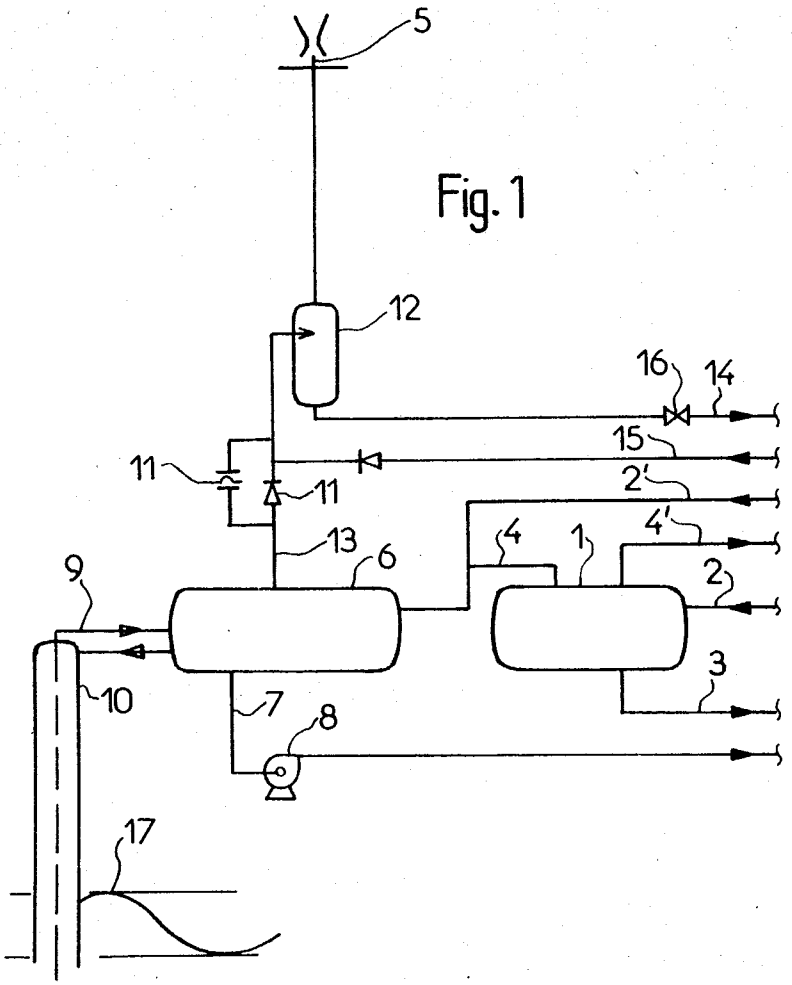
FIG. 1 is a schematic representation of a production installation equipped with a safety device assembly according to a first example of embodiment of the invention, corresponding more generally to a continuous and relatively minor flow of gas coming, for example, from an installation for separation or processing of hydrocarbons.

Referring to FIG. 1, the installation comprises, first of all, either a source of entrainment of liquid hydrocarbons constituted by a separator 1 receiving the crude petroleum or the crude gas through an intake duct 2, or a source of gas constituted by a pipeline 2', or both sources simultaneously. Separator 1 is equipped in classic fashion with a circuit 3 for normal collection of oil and condensates, a circuit 4' for normal collection of gas and a gas outlet connected to a gas flow chain 4 to the tip 5 of the flare. This gas flow chain 4 includes, between separator 1 and flare tip 5, a flare-base flask 6 equipped in classic fashion with a circuit for collection of drips 7 perhaps comprising a pumping means 8 and a safety overflow tube 10 opening below the level 17 of the sea, with breather 9. Separator 1, flare-base flask 6 and safety overflow tube 10 are all three equipped with a high-level detection circuit, which, in case of an abnormally high level of liquid, shuts off the source of supply of crude or of gas to the installation. Following the direction of flow of the gas in flare stack 13, this installation comprises in succession, according to the invention, a back-pressure device 11 paralleled by a bursting plate 11', a liquid separator 12 and a flare tip 5.

If the flaring of the gas is not part of the normal operation of the installation, back-pressure device 11 is shut off, the flow of combustible or inert gas proper to avoiding the entry of air through flare tip 5 is brought either by a lateral pipe 15 or through a small orifice provided through back-pressure device 11. When gas is flared, with, perhaps, fast tripping of the flow, a first damping of the pressure surge will be produced by safety overflow tube 10 thereby serving as a damper, with simultaneous opening of back-pressure device 11 and flow of gas to the flare. A pressure rise upstream of device 11 due to an excessively slow opening, a blockage of the latter or for any other reason, will burst the diaphragm of bursting plate 11' and the flow of gas into flare 5. Any liquids entrained or condensed are trapped in separator 12 and reintroduced into the installations upstream by a pipe 14 equipped with a manual or automatic, piloted or unpiloted liquid purge device 16. The gas then reaches flare tip 5 where the liquids remaining are pulverized and together with the gas are intimately mixed with the ambient air by the effect of a high velocity of ejection and a disposition of tip 5 favoring the diffusion and mixture.

If the flaring of the gas is part of the normal operation of the installation, the back-pressure device 11 will normally be open and the safety device assembly will be in service.

Figure 2:
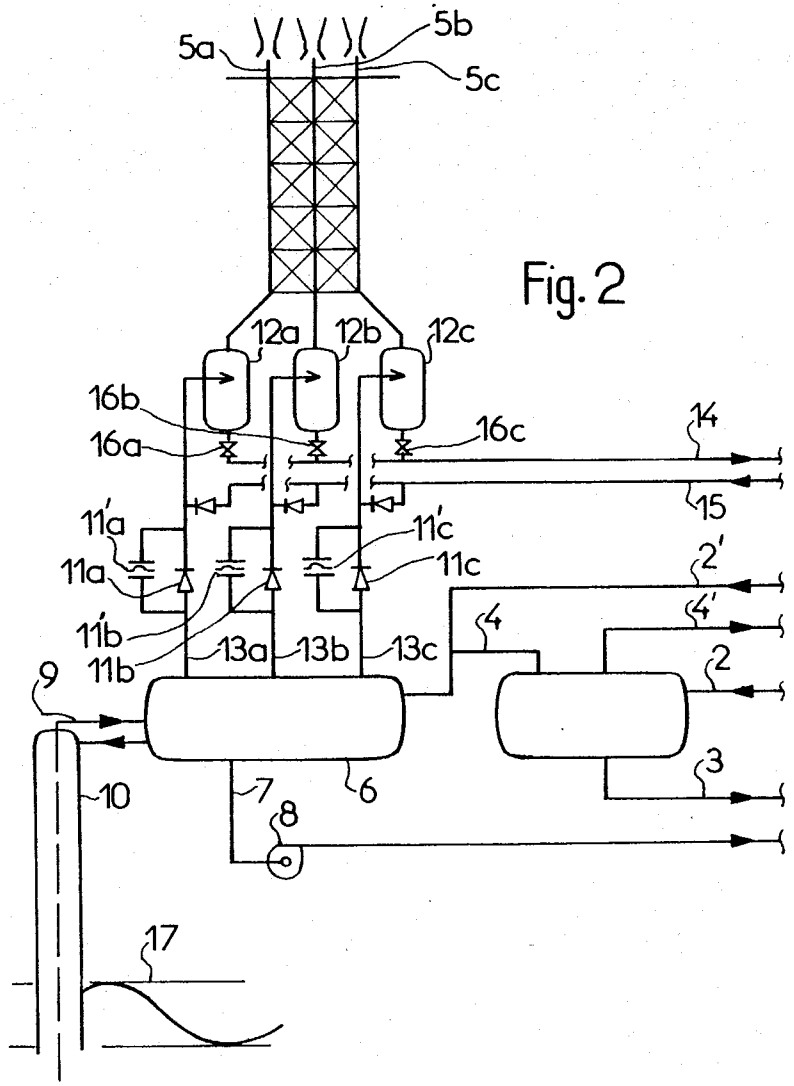
FIG. 2 is a schematic representation of a second installation equipped with the safety device assembly according to a second example of embodiment calling on a plurality of flare stacks, corresponding more generally to a substantial flow of gas with wide fluctuations in flow, or to intermittent flows of gas such as those which can be encountered in installations of production or transportation of gas.

Referring to FIG. 2, the installation comprises a plurality of flare stacks 12*a*, 12*b*, 12*c*, limited to three in the drawing for reasons of clarity only, and each of these can be equipped with the device provided in FIG. 1, in particular the back-pressure devices 11*a*, 11*b*, 11*c* being calibrated at substantially different opening pressures in order to maintain in each flare stack, as a function of the flow to be flared, a sufficiently high velocity in the downstream devices to enable them to operate correctly. Furthermore with a plurality of flares the length of the flame resulting from all of the gas flow will just be that corresponding substantially to the flow passing through one of the flare stacks, and not that corresponding to the entire flow to be flared, regardless of the method of calculation used to determine the length thereof. Moreover, the intensity of the jet and flame noises will be maximum with only one of the flares in operation at maximum flow, and will correspond to the flow passing through it. The successive actuation of the other flares corresponding to an increase in the flow to be flared will result in a diminution of the intensity of the noise defined above.

In a confined installation such as those encountered off shore, the fact of overcoming the length of the flame and the intensity of the noise will in itself justify the implantation of a plurality of flares as soon as the flows of gas to be flared are substantial and variable.

Finally, in a certain number of installations where high gas pressure is available for flaring, without thereby interfering with the overall safety of the installation or with the operation of the set of safety devices, the service pressure of the flare-base flask 6 can be raised to a substantial extent in view of the operation of these auxiliary devices, this leading to a substantial diminution in the corresponding volumes and weights. This advantage can be substantial in offshore installations where costs are very sensitive to weights and volumes.

Figure 3A:
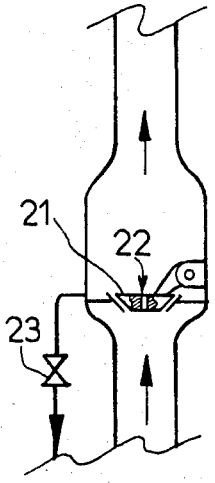
FIGS. 3A, 3B, 3C, 3D, 3E, 3F are schematic representations showing details of embodiment of the back-pressure device.

The back-pressure devices 11, 11*a*, 11*b*, 11*c* can be embodied in different ways and installed in different manners. In the representation in FIG. 3A, the back-pressure device is constituted by a calibrated check valve 21 pierced with an orifice 22, a cock 23 permits manual and periodic verification that there is no accumulation of liquids on the valve to interferw with its working.

Figure 3B:
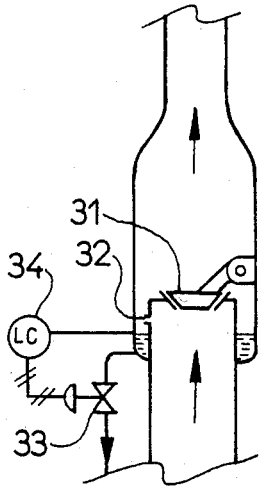
Figure 3C:
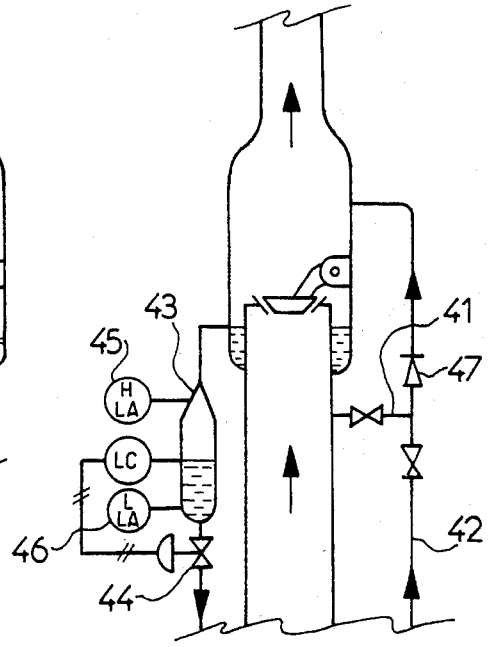

In the representation in FIG. 3B, orifice 32 which helps maintain the gas overlay is pierced laterally in the gas duct above the back-pressure valve 31, the liquids running off in the flare stack are trapped in a bulge in the flare stacks and purged by an automatic valve 33 operated by a level detector 34. In the representation in FIG. 3C, the overlay of combustible gas is maintained by an outside duct 41. The overlay of inert gas is maintained by an outside duct 42, equipped with a non-return check 47, the liquids running off from the top are trapped in a boot 43 and evacuated by an automatic purge valve 44. A detector of abnormally high level KLA 45 and a detector of abnromally low level LLA 46, inform the operators of a malfunction in the drip collection system.

Figure 3D:
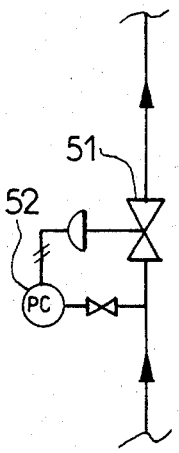

In the representation in FIG. 3D, the back-pressure device is constituted by a valve 51 whose position is governed by a pressure regulator PC 52.

Figure 3E:
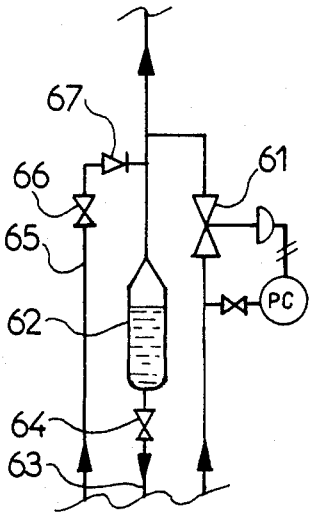

In the representation in FIG. 3E the back-pressure valve 61 is placed laterally to a boot 62 for recovery of drips equipped with a liquid purge duct 63 with a manual valve 64. A pipeline 65 equipped with a valve 66 and a non-return check 67 makes it possible to feed combustible or inert gas to the top of the flare stack during periods of shutdown.

Figure 3F:
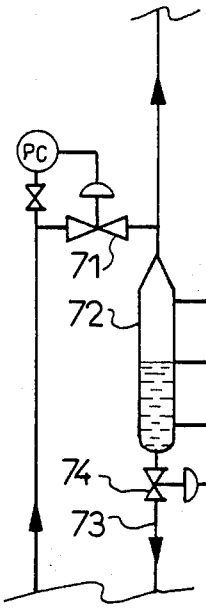

In the representation in FIG. 3F the back-pressure valve 71 is placed on a horizontal or sub-horizontal part of the flare stack. The vertical part of the flare stack downstream terminates at the bottom in a boot 72 for collection of drips. This boot is equipped with a liquid purge duct 73 with a valve 74 operated by a sensor of the liquid level 75. Detectors of abnormally high level 77 and low level 76 inform the operators of malfunctions in the drip collection system.

Figure 4A:
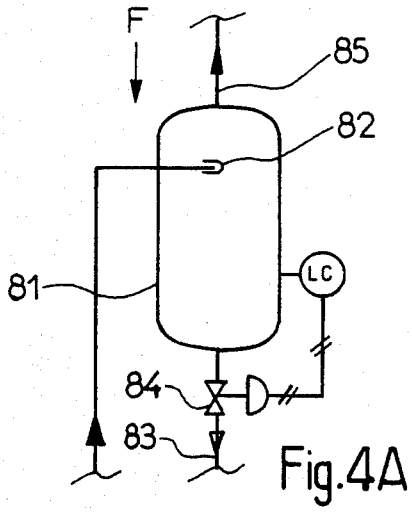
FIGS. 4A, 4B, 4C are schematic representations showing simple details of embodiment of the device for separation of entrained liquids.

The device for separation of liquids entrained can be embodied in different ways and installed in various manners. In particular, the device represented in FIGS. 4A and 4D includes a centrifugal separator 81 with a tangential input 82 of the fluid, the separated liquids being evacuated toward the bottom through a duct 83 for drip collection equipped with an automatic purge device 84 and the gases toward the top through the downstream part of flare stack 85, FIG. 4B proposes a horizontal or subhorizontal disposition in which the gas input 91 is connected to a bulge 92 in the duct, having a central core 93 connected to the outside tube by spiral vanes 94, imparting a helical movement to the fluids passing through it. The gas issuing from this device goes to the flare tip through a duct 95 while the liquids adhering to the wall are collected in a boot 96 equipped with a purge duct 97 with a valve 98 operated by a level detector 99. High level 100 and low level alarm 101 inform the operators of any malfunction in the purge system.

Figure 4C:
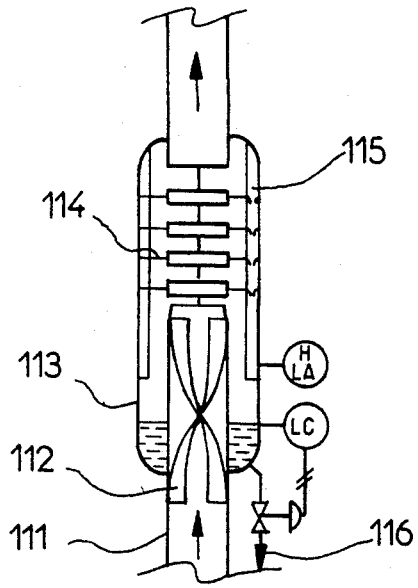
Figure 4D:
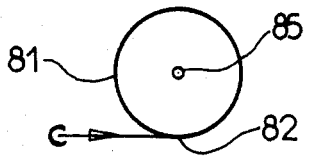
FIG. 4D is a schematic view along arrow F of FIG. 4A.
Figure 4B:
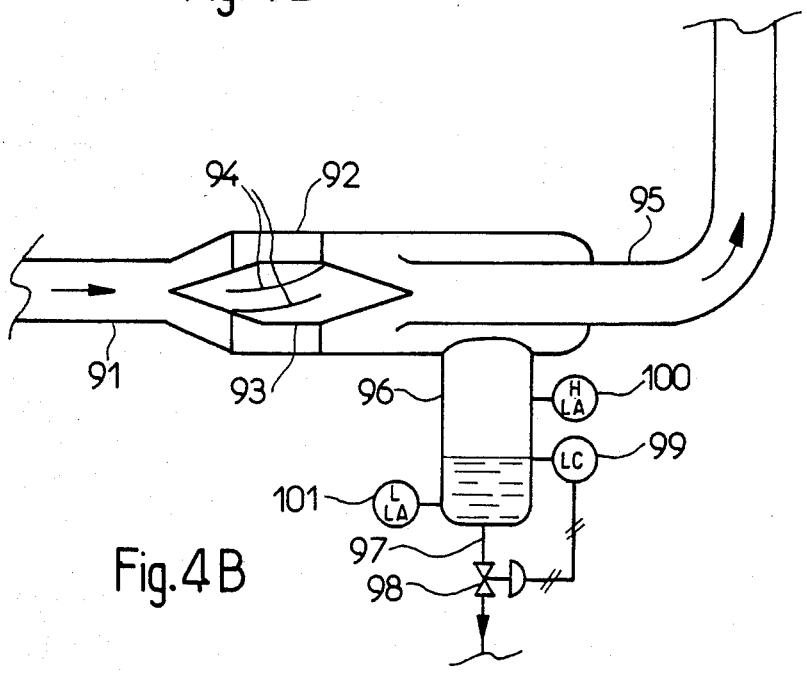

The device represented in FIG. 4C relates to a device similar to the one in FIG. 4B but which can be placed vertically on the flare stack in order to reduce the bulk. Furthermore entry pipe 111 is not bulged and has spiral vanes 112 which do not necessarily cover the full section of pipe 111. Chamber 113 for liquid recovery has plates pierced with holes 114 catching the liquids entrained, and vertical gutters 115 channeling them toward the bottom of the device where they will be withdrawn through a duct 116 equipped with devices as in the preceding examples.

The flare tip can be embodied in various ways which will always be installed vertically or subvertically. For example, in FIG. 5A the end of flare stack 121 has a calibrated nozzle 122 of reduced circular section to speed up the gas, opening above a horizontal circular plate 123 with vertical radial vanes 124 to guide the streams of air or wind into the convergent-divergent part of a venturi 125 whose neck 126 will be placed slightly above the upper end of nozzle 122 in order to obtain the desired effect of entrainment of air. The outer surface of venturi 125 can be provided with vertical vanes 130 to guide the streams of air or wind. The upper end of the venturi will have a perforated, circular, inner crown 127 to permit the flame to "catch." If low-pressure gas were to be eliminated, this could be embodied by a pipe 128 opening at 129 in the venturi, beyond the neck, in the negative-pressure zone of the said venturi. In FIG. 5B the flare tip can include the same devices as FIG. 5A but it differs from the latter in that the outlet nozzle for gas is replaced by a circular annular crown 132 in which the gas input is axial in direction 135 or tangential 135' to the crown 132, depending on the effect desired. Furthermore, a central core 133 can be placed in the center of the device to accentuate the venturi effect for certain applications. Vanes 134 for suspension of the central core 133 can be plane and vertical, or have a helical surface in order to be adapted to the desired guidance effect.

Figure 5A:
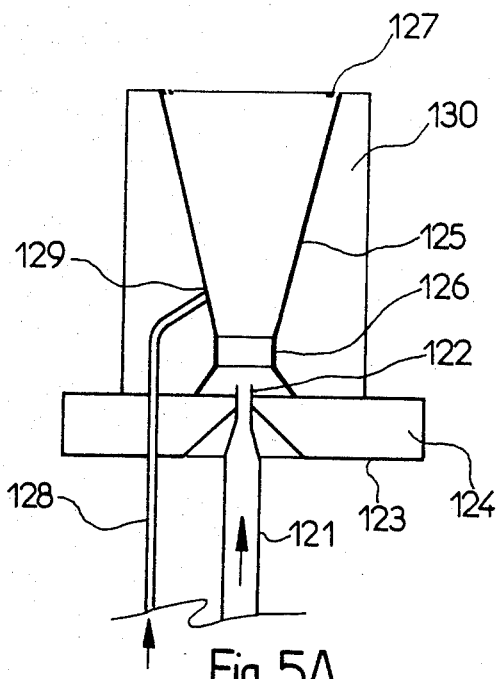
FIGS. 5A, 5B, 5C, 5F are schematic representations showing details of embodiment of the device for pulverization of the liquids entrained or condensed, and aeration of the gas jet with flame stabilization.
Figure 5B:
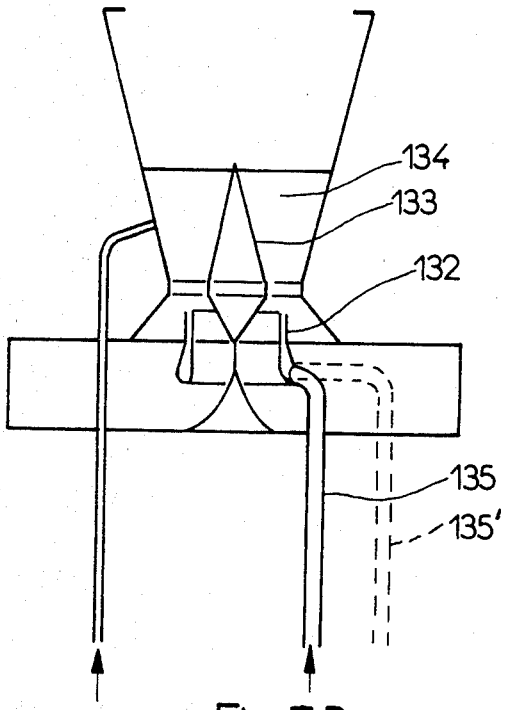
Figure 5C:
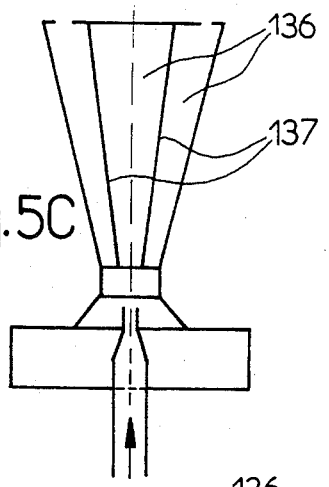
Figure 5E:
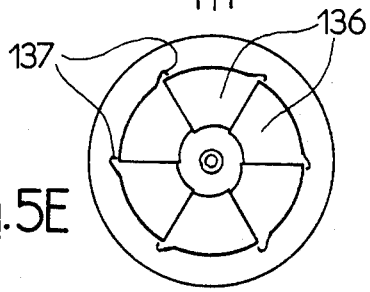
FIG. 5E is a schematic overhead view of FIG. 5C.

In FIG. 5C, the disposition of the elements constituting the flare tip is similar to those provided in FIGS. 5A and 5B, but it differs in that the upper part of the venturi is a set of petals 136 admitting air laterally through slots 137 to improve the air-gas mixture.

Figure 5F:
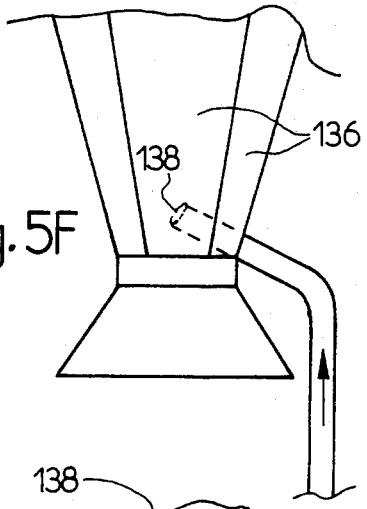
Figure 5D:
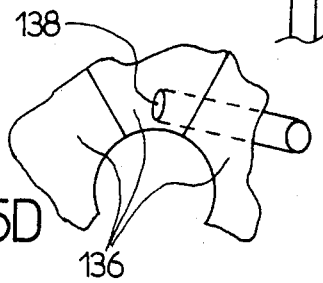
FIG. 5D is a fragmentary and schematic overhead view of FIG. 5F.

FIG. 5F proposes a disposition similar to the preceding, but in which the gas outlet takes place through a lip 138 tangent to the internal surface of the venturi, either in the bottom thereof or at the neck, or as represented in its divergent part, this lip being inclined to the axis of the cone so as to impart an ascending spiral movement to the gas.

Figure 6:
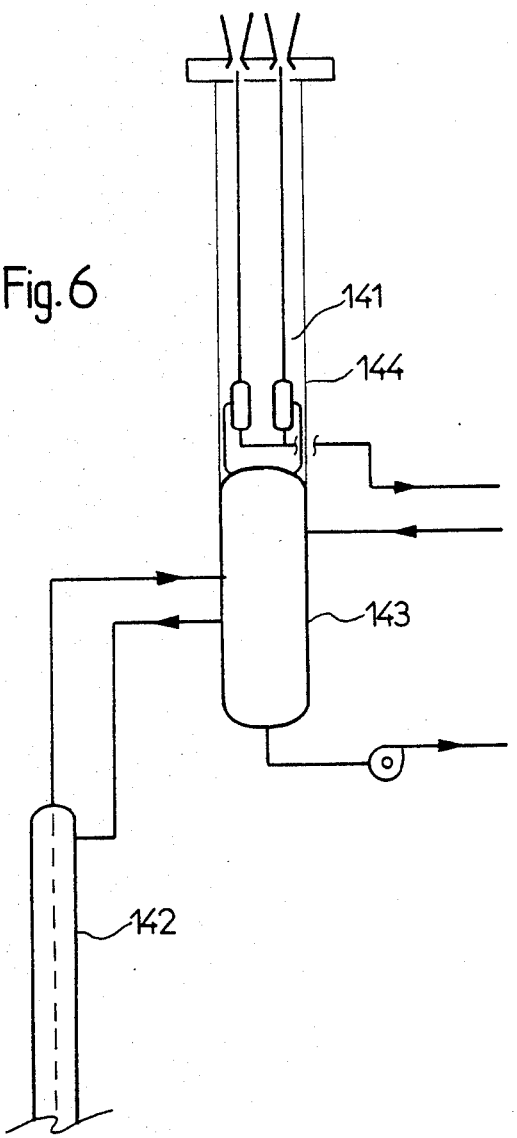
FIG. 6 is a schematic representation of the safety device assembly in which the lower part of the flare stack serves as a flare base flask in order to obtain a less bulky installation.

For certain applications, the embodiment represented in FIG. 6 offers a simplified solution of very small bulk in which all the elements of the system are assembled in two vertical or subvertical units, one ascending 141 and the other descending 142, connected together and to the installations by the piping necessary for their operation. The vertical ascending unit has, at its base, the vertical flare-base flask 143 surmounted by a housing 144 surrounding all the required components up to the flare tip, and whose principle functions are:

to protect the elements of the system from the outside elements such as frost and ice, to support the elements of the system, to permit access for control and maintenance of the elements of the system up to the flare tip;

to improve the aerodynamic profile of the system in order to diminish the outside loading to be allowed for in designing this structure;

for heating, where applicable, the system as a whole by some means such as steam, heat-bearing fluid or electricity, to palliate the problems created, for example, without limitation thereto, by the accumulation of frost on the surfaces in contact with the atmosphere or deposits of gas hydrates in the equipment and piping.

The descending vertical part 142 can also be equipped with a similar housing in order to obtain similar advantages.

Figure 7:
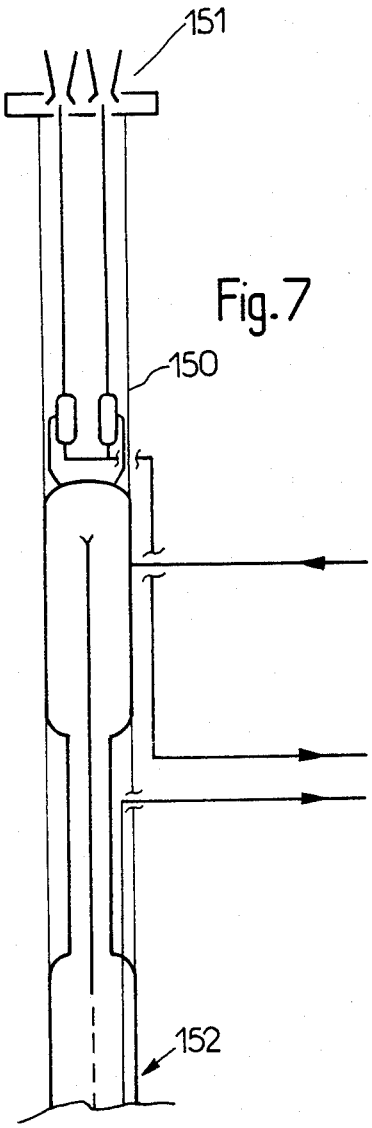
FIG. 7 is a schematic representation of the safety device assembly in which all its component elements are aligned on a generally vertical axis with direct opening of the bottom of the flare-base flask into the sea.

In addition, a further simplification will consist in embodying the flare and overflow column as a continuous pipe, perhaps variable in section, as represented in FIG. 7, in which continuous pipe 150 constitutes active parts of the system and of the protective housings of the elements of the system, from the flare tip 151 to the end of the overflow tube 152.

Finally, in all the configurations of installations of this safety system, the latter can use, for its embodiment, parts of already existing pipes, made of steel or other materials, and capable of serving other functions such as the supporting of installations. This supporting can also be embodied from other elements such as frames, whether or not required for other functions.

I claim:

1. Safety system to eliminate liquids, as well as to limit the heat radiation and intensity of noises received, during the discharge of gases from an installation handling flammable fluids characterized in that the system introduces, in the flow chain of the gas (4) between a potential source of liquid and a vent to the atmosphere, a flare-base flask means connected at its upper part to at least two flare stacks (13) each stack (13) comprising:

a back-pressure device (11) the pressure at which the back-pressure devices open to conduct gas upstream thereof being different for each flare (13), so that during a continuous increase in the pressure of the gases, the result is a staged successive opening of the back-pressure devices (11), and thus the velocity of flow of the gas inside the flare stacks (13) will always be relatively high, and a venting orifice equipped with means to pulverize, into a mist any drops of liquid remaining in the gas flow and to quickly assure an intimate mixture of the gas with the ambient air in order to obtain rapid and complete combustion and thereby avoid the condensation and fallout of the liquid drops in the vicinity thereof, as well as a short flame with little radiation.

2. System according to claim 1, characterized in that the back-pressure device (11) comprises a valve (51) that can be isolated by means of a locked valve open when the installation is in service and piloted by the pressure upstream, this back-pressure device being equipped with at least one orifice (22) to maintain an atmosphere of gas, in the downstream part of the flare stack and thereby avoid the entry of air through the upper end, and in that the said back-pressure devices are paralleled by a fast-positive-opening device (11'), to limit the upstream pressure at a preselected value, and this back-pressure device itself can be isolated by means of locked shutoff valves open when the installation is in service.

3. System according to one of the preceding claims, characterized in that the control of the atmosphere in the downstream part of the flare stack is provided by an auxiliary gas feed pipe (15) equipped with a non-return valve.

4. System according to claims 1 or 2 characterized in that each flare stack (13) is equipped with a liquid separator (12) including vanes (112) for catching the liquids on the wall of the tube, these liquids being collected in a boot (113) and recycled in the upstream liquid-processing installations; and in that this liquid separator (12) is equipped with a liquid detection system and a pipeline for evacuation of the liquids, the detection of an abnormal level actuating an alarm and causing a purge of the accumulated liquids.

5. System according to claims 1 or 2 characterized in that the venting orifice (5) of the flare stack (13) includes a pipe with reduced section of passage (122) to give the gas a high velocity as it is vented, the section of passage for the gas having an annular form (132) to minimize the formation in the axial part of the jet of a central core of gas that can diffuse in the atmosphere only at a relatively substantial distance from the tip of the flare.

6. System according to claim 5, characterized in that the venting orifice (5) is situated upstream of the neck of a venturi (125) at a distance so that the desired air entrainment effect is obtained, the upper edge of the venturi being equipped with an inside lip (127) to promote the catching of the flame and the stability thereof, in that the venting orifice (5) is equipped at its base with a substantially horizontal plate (123) equipped with vertical vanes (124) for guiding the streams of air and vertically channeling the wind reaching the flare tip (5), and in that the venturi (125) itself is equipped with external vertical vanes (130) for quiding the streams of air and wind, and permitting the dissipation of any heat accumulated in the body of the venturi (125).

7. System according to claims 1 or 2 characterized in that the inner end of the venting orifice (5) has vanes to guide the streams of gas, and to impart a helical movement to the jet of gas, and in that venting orifice (5) is narrowed and opens tangentially in the interior and in the bottom part of a funnel having metal petals (137) offset radially with respect to one another to permit the tangential entry of air entrained by the jet of gas into the interior of the funnel and the intimate mixing thereof with the gas.

8. System according to claims 1 or 2 characterized in that it further comprises a separator (1) receiving the flammable fluid through at least one duct (2) and equipped with a circuit (3) for collection of liquids, and in that the flare-base flask means (6) is equipped with a drip collection circuit (7), and in that the separation (1) and flare-base flask means (6) are equipped respectively with circuits detecting abnormal operating conditions to terminate the feed of the fluid to the installation when operations exceed prefixed values.

9. System according to claims 1 or 2 characterized in that the flare-base flask means (6) is preportioned as a two-phase separator and in that it includes an overflow column (10) opening below the level of the liquid, and a breather tube (9) inserted in the said flare-base flask means.

10. System according to claims 1 or 2 characterized in that the flare stacks (13) constitute a support structure for at least some of the elements of the system.

11. System according to claims 1 or 2 characterized in that the flare stacks (13) are at least partially enclosed inside a sheath (144) to protect the flare stacks and to facilitate maintenance and repair thereof.

12. A safety system to eliminate liquids, as well as to limit the heat radiation and the intensity of noises received, during the discharge of gases from an installation handling flammable fluids characterized in that the system introduces, in the flow chain of the gas (4) between a potential source of liquid and a vent to the atmosphere, a flare base flask connected at its upper part to a flare stack (13), characterized in that the flare stack comprises:

a back pressure device (11) to maintain the velocity of flow of the gas inside the flare stack relatively high; and a venting orifice (5) equipped with means to pulverize into a mist any drops of liquid remaining in the gas flow and to quickly assure an intimiate mixture of the gas with the ambient air in order to obtain rapid and complete combustion and thereby avoid the condensation and fallout of the liquid drops in the vacinity thereof, as well as a short flame with little radiation.

* * * * *